US007878091B2

(12) United States Patent
Abel et al.

(10) Patent No.: US 7,878,091 B2
(45) Date of Patent: Feb. 1, 2011

(54) SCREWDRIVING TOOL WITH FREE WHEEL GEAR

(75) Inventors: Michael Abel, Radevormwald (DE); Andre Mueller, Wuppertal (DE); Oliver Pistor, Wuppertal (DE); Martin Strauch, Wuppertal (DE)

(73) Assignee: Wera Werk Hermann Werner GmbH & Co. KG (DE)

( * ) Notice: Subject to any disclaimer, the term of this patent is extended or adjusted under 35 U.S.C. 154(b) by 0 days.

(21) Appl. No.: 12/533,915

(22) Filed: Jul. 31, 2009

(65) Prior Publication Data

US 2010/0058896 A1 Mar. 11, 2010

Related U.S. Application Data

(63) Continuation of application No. PCT/EP2008/050187, filed on Jan. 9, 2008.

(30) Foreign Application Priority Data

Feb. 1, 2007 (DE) ..... 10 2007 004 987
Oct. 15, 2007 (DE) ..... 10 2007 049 304

(51) Int. Cl.
*B25B 13/46* (2006.01)
*B25B 23/16* (2006.01)

(52) U.S. Cl. ..... 81/60; 81/177.9

(58) Field of Classification Search ..... 81/60, 81/177.8, 177.9, 29
See application file for complete search history.

(56) References Cited

U.S. PATENT DOCUMENTS 1,559,097 A 10/1925 Hill
1,601,767 A 10/1926 Peterson
1,643,855 A 9/1927 Peterson
3,342,229 A 9/1967 Janes
3,475,999 A 11/1969 Roberts et al.
4,054,067 A 10/1977 Blank
4,541,310 A 9/1985 Lindenberger (Continued)

FOREIGN PATENT DOCUMENTS

DE 499786 C 6/1930

(Continued)

OTHER PUBLICATIONS

International Search Report; PCT/EP2008/050187; Mar. 4, 2009; 4 pages.

*Primary Examiner*—David B Thomas
(74) *Attorney, Agent, or Firm*—St. Onge Steward Johnston & Reens LLC

(57) ABSTRACT

A screwdriving tool includes a gear head and a drive arm. The gear head forms a gear housing, in which a free wheel or ratchet gear having an output rotational axis is arranged. A front side of the gear head includes an output coupling, in the shape of a polygon. The drive arm can be pivoted about a pivot axis, which is substantially transverse to the output rotational axis, from a quick-action screwdriver position, in which the drive arm is in the output rotational axis, into a power-action screwdriver position, in which the drive arm extends substantially transversely to the output rotational axis and can be fixed in both pivot positions by detents. The detents can be moved from a detent position into a release position by means of an actuating member associated with the drive arm.

14 Claims, 13 Drawing Sheets

U.S. PATENT DOCUMENTS

| | | | | |
|---|---|---|---|---|
| 4,799,407 | A | 1/1989 | Miyamoto | |
| 5,279,189 | A * | 1/1994 | Marino | 81/177.8 |
| 6,167,787 | B1 * | 1/2001 | Jarvis | 81/177.2 |
| 6,324,947 | B2 * | 12/2001 | Jarvis | 81/177.2 |
| 6,634,262 | B2 | 10/2003 | Malchus | |
| 6,971,292 | B2 * | 12/2005 | Hu | 81/177.8 |
| 6,976,411 | B1 | 12/2005 | Yu | |
| 7,497,148 | B2 * | 3/2009 | Stucky | 81/60 |
| 2001/0000092 | A1 | 4/2001 | Jarvis | |
| 2003/0029284 | A1 | 2/2003 | Malchus | |
| 2004/0177731 | A1 * | 9/2004 | Chen | 81/177.8 |
| 2005/0166718 | A1 | 8/2005 | Chang | |
| 2006/0201288 | A1 | 9/2006 | Chen | |

FOREIGN PATENT DOCUMENTS

| | | | |
|---|---|---|---|
| DE | 2116286 | | 4/1971 |
| DE | 202004000843 | U1 | 4/2004 |
| DE | 202006007090 | U1 | 7/2006 |
| FR | 2865677 | A1 | 8/2005 |

* cited by examiner

SCREWDRIVING TOOL WITH FREE WHEEL GEAR

CROSS-REFERENCE TO RELATED APPLICATIONS

The present application is a continuation of pending International patent application PCT/EP2008/050187 filed on Jan. 9, 2008 which designates the United States and claims priority from German patent application Nos. 10 2007 004 987.2 filed on Feb. 1, 2007 and 10 2007 049 304.7 filed on Oct. 15, 2007, the content of which is incorporated herein by reference.

FIELD OF THE INVENTION

The invention relates to a screwdriving tool with an actuating arm formed at one end as a handle portion and a freewheel gear arranged at the other end, and having a gear head which can be turned round at least through 90° into retained positions.

BACKGROUND OF THE INVENTION

In the case of the previously known solutions of this type (US-A 2006/0201288 A1), provided between the handle and the gear head is an intermediate portion of the actuating arm that provides sufficient length of the handle for the torque that is to be applied in the pivoting screw-tightening movement. The intermediate portion is split over half its length, in order to allow it to perform a gap adjustment, which hinders the ease with which the gear head can be turned round, in order for example to ensure safe handling when undertaking a screw-tightening action with the gear head in such a position that its drive output element is in line with the actuating arm. Conversely, it is intended to make it easier to set the feature allowing the gear head to be turned round when the drive output element is aligned in the transverse position in relation to the actuating arm. This changing-over of the tool to the two, usually successive, screwing-up movements of a screw is unsatisfactory.

In addition, there are known screwdriving tools with universal joints provided at one end of an actuating arm, having on the actuating arm a transverse arm for applying the sufficiently great screw tightening force. The actuating arm itself in this case has a sheathing sleeve disposed on it. A genuine quick-action screwdriver position that can usually be switched conveniently to the so-called power-action screwdriver position, with the actuating arm directed transversely to the screw axis, is not envisaged and not possible.

It is an object of the invention to form a screwdriving tool of the type in question in such a way that it is optimally designed for two-handed actuation, irrespective of the angular position in which the reversible gear head is located in relation to the actuating arm. It is intended that, in every position of the gear head, both hands contribute to facilitating etc., the screwdriving operation.

This is achieved by a screwdriving tool with an actuating arm formed at one end as a handle portion and a freewheel gear arranged at the other end, and having a gear head which can be turned round at least through 90° into retained positions.

As a result of this configuration, the operator can use both hands—if need be even at the same time—to introduce a number of differently directed operating forces simultaneously into the screwdriving tool. It has been found that, in the quick-action screwdriver position, the tool can surprisingly be positioned and retained in a screwing-in direction so accurately with the hand grasping the sleeve that, with the other hand on the handle portion, it is possible by interrupted discrete gripping actions to give to the tool such great angular momentum that in the case of such tools, masses that are non-uniformly distributed on the circumference in the gear head act as centrifugal masses, which then maintain the screwing movement by self-acting further turning of the tool when the grip on the end of the handle is shifted, until it is grasped once again. Equally, the sleeve to be grasped by one of the hands helps to position the screwdriving tool. This applies both in the positive power-action screwdriver position and in the quick-action screwdriver position. Similarly, in the positive power-action screwdriver position, the actuating arm can be gripped around firmly with both hands without any strain on the hands, the hand that is gripping around the sleeve being able to carry out a height adjusting movement in relation to the securing hand, so that the hand grasping the handle portion can even safely let go and grasp.

U.S. Pat. No. 6,634,262 discloses a screwdriving tool with a gear head and a drive arm, the gear head forming a gear housing in which a freewheel or ratchet gear having an output rotational axis is disposed, a front side of the gear head having an output coupling in the form of a polyhedron, and the drive arm being pivotable about a pivot axis, which lies substantially transversely to the output rotational axis, from a quick-action screwdriver position, in which the drive arm lies in the output rotational axis, into a power-action screwdriver position, in which the drive arm extends substantially transversely to the output rotational axis, and the drive arm being fixed in both pivoted positions by detent means, the detent means being displaceable from a detent position into a release position by means of an actuating member associated with the drive arm. In the case of this screwdriving tool, the actuating means is a pin which can be displaced parallel to the pivot axis. This pin interacts with a detent ball, which interacts with detent recesses of a bearing extension of the gear head. The bearing extension is a narrow portion of the gear head that lies opposite from the square drive output element. This extension is passed through by a bearing screw.

DE 21 16 286 and DE 20 2006 007 090 U1 disclose screwdriving tools in which a ratchet gear has a square drive output element, the ratchet gear is disposed in a gear head and the gear head is fitted pivotably in a bifurcated opening of a drive arm.

DE 20 2004 000 843 discloses a screw wrench in which the gear head is located in a bearing fork of the drive arm. A handle disposed on the drive arm can be displaced along the drive arm. A similar screwdriving tool is described by US 2005/0166718 A1.

DE 499 786 discloses a tool with a pivotable lever. The lever is located in a lateral recess of a handle and can be pivoted by 90° about a pivot axis.

FR 2 865 677 likewise discloses a screwdriving tool. The drive arm is connected to a drive output blade in an axially fixed manner. The drive arm comprises two parts. One part can be pivoted about a pivot axis into a 90° position.

U.S. Pat. No. 6,976,411 discloses a screwdriving tool in which a pivot handle that protrudes at right angles from the output rotational axis is mounted on a drive arm.

U.S. Pat. No. 4,799,407 discloses a screwdriving tool in which a handle protruding at right angles is likewise provided, in order to increase the torque that can be applied to an output coupling. For this purpose, the screwdriver known from U.S. Pat. No. 3,475,999 also has a handle that is pivotable by 90°.

U.S. Pat. No. 4,541,310 describes a screwdriving tool with a drive arm which is connected to a gear head by means of an eccentric joint. The drive arm can be brought from a quick-action screwdriver position through 90° into a power-action screwdriver position.

In the case of the screwdriving tool known from U.S. Pat. No. 1,559,097, a pivoting handle that can be pivoted from a quick-action screwdriver position into a power-action screwdriver position is located in a recess in the handle. A similar solution is described by U.S. Pat. No. 3,342,229.

U.S. Pat. No. 1,601,767 describes a screwdriving tool with a drive arm which is fixedly connected to a gear head. A screwdriver handle may be fitted onto a drive projection of the gear head. A similar solution is described by U.S. Pat. No. 4,054,067.

It is an object of the invention to develop the screwdriving tool mentioned at the beginning advantageously in terms of its use.

SUMMARY OF THE INVENTION

The object is achieved by the invention specified in the claims, though each claim represents an independent way of achieving the object.

First and foremost, two diametrically opposed centrifugal masses are provided, associated with the drive arm and having a sleeve that is associated with the drive arm in an axially fixed but rotatable manner. The centrifugal masses may be disposed adjacent a bearing fork for the gear head that forms two fork prongs. The rotatable sleeve may be adjacent a handle associated with the free end of the drive arm. This handle preferably has rotational symmetry, so that angular momentum which sets the screwdriving tool into an ongoing rotational movement in the quick-action screwdriver position can be easily imposed on this handle by means of the thumb, index finger and middle finger. The fork prongs are rooted in a widened portion of the drive arm. This widened portion of the drive arm, with which the sliding button is also associated, forms diametrically opposed convexities. Since the material of the drive arm, and correspondingly also of the convexities, is a metal, preferably steel, the convexities have a mass. They act as a centrifugal mass, in order to improve the "twisting" of the screwdriving tool in the quick-action screwdriver position. In the quick-action screwdriver position, a torque can be applied to the rear end of the handle by the user's fingers. The user's other hand grips around a free-running sleeve, which is mounted on the drive arm in an axially fixed but rotatable manner. As a result of the centrifugal mass, angular momentum built up in this way only decays slowly. The tool can rotate freely within the free-running sleeve. The centrifugal mass ensures that the square drive output element can rotate through many revolutions. As a result, even relatively long screws can be quickly screwed in or out of a thread. The main components of the screwdriving tool comprise the gear head and a steel body which forms the bearing fork for the gear head, a shank portion for mounting the rotatable sleeve and an end portion to which the handle is secured. The handle may consist of plastic and be fitted or molded onto the end portion of the shank. The centrifugal masses are formed by the steel body. Both the fork and the centrifugal masses are integrally formed from the same material on the steel body, which is preferably formed by a hardened forged part. In order to impose its own rotation, sustained over multiple revolutions, on the screwdriving tool in the quick-action screwdriver position, the mass moment of inertia of the steel body with respect to the input rotational axis should lie above a minimum value in the quick-action screwdriver position. In the power-action screwdriver position, on the other hand, the mass moment of inertia of the steel body should lie below a maximum value, in order that the smallest possible decelerating torque has to be applied when there is a reversal of direction in the power-action screwdriver mode. For this purpose, the steel body extends only by a certain extent into the plastic handle, so that the free end of the handle is formed by the plastic handle part. Both the minimum value and the maximum value depend considerably on the overall size of the screwdriving tool. There are substantially three different size classes, each of which relates to a specific size of the output coupling. The minimum value of the mass moment of inertia of the steel body in the quick-action screwdriver position and the maximum value of the mass moment of inertia of the steel body in the power-action screwdriver position depend on the size of the output coupling. The values are greater for screwdriving tools with a ½-inch output coupling than for a screwdriving tool with a ⅜-inch output coupling. The latter values are in turn greater than in the case of a screwdriving tool with a ¼-inch output coupling. In order to achieve the optimum mass distribution, the centrifugal masses are disposed near the bearing fork. In the case of a screwdriving tool with a ½-inch output coupling, the minimum value of the mass moment of inertia in the quick-action screwdriver position is 30 kg $mm^2$, preferably 40 kg $mm^2$, still more preferably 45 kg $mm^2$. In the case of a screwdriving tool with a ⅜-inch output coupling, the minimum value of the mass moment of inertia in the quick-action screwdriver position is preferably 15 kg $mm^2$, more preferably 20 kg $mm^2$, still more preferably 25 kg $mm^2$. In the case of a screwdriving tool with a ¼-inch output coupling, the minimum value of the mass moment of inertia in the quick-action screwdriver position is preferably 3 kg $mm^2$, more preferably 4 kg $mm^2$, still more preferably 4.5 kg $mm^2$. In a development of the invention, the gear housing has two diametrically opposed socket-shaped extensions. Each of the two extensions forms two driving flanks facing away from each other. In the power-action screwdriver position, these driving flanks lie against driving steps of the fork prongs. The root region between the two fork prongs has a recess in the form of a space, into which the one or the other radial extension can come to lie, depending on the rotational position of the gear head, the driving flank lying against the driving step. In the quick-action screwdriver position, this space may form a free space which extends above the vertex of the domed portion. The detent pin passes through this free space. A considerable part of the mass of the screwdriving tool is formed by the aforementioned widening of the handle adjoining the fork prongs. The center of gravity of the drive arm correspondingly lies directly behind this widening of the handle that is adjoined by the free-running sleeve. This makes the screwdriving tool top-heavy when it is held by the rotatable sleeve. While the centrifugal mass achieves its optimum effect in the quick-action screwdriver position, it is, as it were, neutralized in the power-action screwdriver position, since it is disposed near the rotational axis. The centrifugal mass is preferably formed by radially outwardly facing convexities. These convexities leave dished grips between them. The fingers of the user's hand can be placed in these dished grips when the screwdriving tool is used in the power-action screwdriver position. The user's hand then rests on the bearing body that provides the rotational mounting for the gear head. The fingers reach into said dished grips. As a result of the concentration of mass in the region of the gear head, the screwdriving tool can also be operated with one hand in the power-action screwdriver position, that is to say by means of the hand gripping the gear head, the fingers of which reach into the dished grip. It proves to be advantageous in this respect if the center of gravity lies in the third of the drive arm near the head. The center of gravity preferably lies in the region of the end of the concentration of centrifugal mass on the handle side. It may in this case also be disposed between the centrifugal mass itself and the rotatable sleeve.

The invention also relates to a screwdriving tool with a drive arm and a freewheel gear having a rotational axis, the drive arm being pivotable about a pivot axis extending transversely to the rotational axis from a quick-action screwdriver position, in which the drive arm lies in the rotational axis, into a power-action screwdriver position, in which the drive arm extends substantially transversely to the rotational axis.

Such a tool is already known from DE 202004000843 U1. A similar tool is described by DE 202006007090 U1.

A ratchet with a pivotable drive arm which at one end has a fork opening in which the ratchet head is pivotably mounted is also described by DE 2 116 286.

On the basis of this prior art, it is an object of the invention to develop the tool of the type in question advantageously in terms of its use.

The object is achieved by the invention specified in the claims, though each claim represents an independent way of achieving the object and can be combined with every other claim.

First and foremost, it is proposed that the drive arm can be fixed either in the power-action screwdriver position or in the quick-action screwdriver position by detent means. The detent means are preferably such that they can only be released deliberately.

The detent means comprise detent recesses. A detent recess may be disposed in the region of the vertex of a domed direction-of-rotation reversing switch. Further detent recesses are in the region of an annular housing, in a position respectively offset by 90° about the pivot axis. The shank of the drive arm preferably bearingly mounts a latch slide. This latch slide has a locking projection, which in the detent position lies in one of the detent recesses. By means of a suitable actuating portion, which is preferably associated with the handle or else with the shank, the latch slide can be withdrawn from a detent position against the restoring force of a spring. Only then can the freewheel gear be pivoted. In a preferred development of the invention, additional detent recesses are provided, so that the drive arm can also be fixed in intermediate positions between the power-action screwdriver position and the quick-action screwdriver position. On the shank of the drive arm, formed in particular by two legs of a fork, a sleeve may be rotatably mounted. This sleeve may be axially fixed. In the quick-action screwdriver position, this sleeve can be used for axially fixing the tool with one hand, while the handle is turned with the other hand.

The invention relates to an extension piece for a screwdriving tool with a shank, one end of which forms a coupling outer cross-section, in particular a polyhedral outer cross-section, and the other end of which has a coupling cavity matching the coupling outer cross-section.

Such extension pieces are known in the prior art as accessories for a ratchet. A ratchet of this kind comprises a head, which includes a freewheel gear also referred to as a ratchet gear. Protruding therefrom is a drive arm. Pivoting the drive arm allows a square drive output portion to be turned step by step in a reversible direction of rotation. The coupling cavity of the extension piece is fitted onto the drive output portion. The coupling outer cross-section can then be fitted into a socket.

It is an object of the invention to develop the extension piece of the type in question advantageously in terms of its use. The object is achieved by the invention specified in the claims. Each claim represents an independent way of achieving the object and can be combined with every other claim.

A main feature is a rotatable and axially fixed sleeve that is disposed on the shank. The sleeve may be fluted on the outside. A bearing ring serves for the axial fixing. This bearing ring lies in an outer circumferential groove of the shank. It protrudes beyond the surface of the shank and engages in an inner groove of the cavity of the sleeve. The sleeve can consequently rotate about the axis of the shank. However, it is not axially displaceable with respect to the axis of the shank. This development leads to an improvement in the functioning of the extension piece. While the drive lever can be pivoted back and forth with one hand, the extension piece can be held with the other hand. The sleeve can be firmly held by the user's hand. An axial force can be exerted on the socket by way of the sleeve. For this purpose, the sleeve can, thanks to its rotatability, also be firmly grasped during the pivoting of the drive arm. The following features are essential to the invention, both on their own and in combination: the freewheel gear has a direction-of-rotation reversing switch disposed on the drive output side. The direction-of-rotation reversing switch is formed by a switching ring. The drive output element is formed by a chuck for receiving a screwdriver insert. The positive securing comprises a detent ball lying in a detent recess. The drive arm has protrusions on its side facing the screwdriver handle, of a profile allowing them to engage in matching circumferential flutes of the screwdriver handle. For the transfer of torques to the drive output portion, the screwdriver handle is connected in a rotationally fixed manner to the drive input portion. The handle is connected to the drive output portion pivotably with respect to the axis A and is capable of transferring torques to the drive output portion in the pivoted state. The latch slide may protrude into the handle. The sleeve is fixed axially on the shank by a bearing ring lying in a circumferential groove.

To develop the screwdriving tool known from U.S. Pat. No. 6,634,262 B2 advantageously in terms of its use, it is provided that the detent means is a latch pin which is disposed in the drive arm and can be displaced in the direction in which the latter extends. The latch pin may in this case lie in an axial bore of the drive arm. It can be displaced from its detent position into its release position against the restoring force of a spring. A sliding button preferably serves for this purpose. This sliding button may be located directly adjacent the gear head, on a broad side of a widening of the drive arm. Two sliding buttons are preferably provided, located on opposite broad sides of the drive arm. These sliding buttons may be connected to each other or connected to the latch pin by means of connecting cross-pieces. The gear housing preferably has a substantially circular outer wall. On the outer wall there are two diametrically-opposed bearing openings, in which bearing pins are inserted. The pivot axis formed by the two bearing pins intersects the output rotational axis substantially at right angles. The gear housing is connected to the bearing pins by the ends of arcuate prongs of the drive arm. The two prongs form a securing fork embracing the gear housing. Midway between the two prongs, the end of the latch pin protrudes into the space defined by the fork. The latch pin can be withdrawn from the space defined by the fork by the two sliding buttons, which are coupled to one another for purposes of movement. The gear head forms a domed portion. The surface of the domed portion is part of a spherical surface. In the domed portion there are a number of detent recesses, which the end of the latch pin can enter in order to fix the gear head in various pivoted positions with respect to the drive arm. In a first pivoted position, which corresponds to a quick-action screwdriver position, the elongate axis of the drive arm lies in the output rotational axis. On the end of the drive arm there is a screwdriver handle. If this handle is turned about its elongate axis, the square drive output element of the gear head is turned about its output rotational axis. By pulling the sliding button back into a release position, the latch pin comes out of the detent recess disposed at the vertex of the domed portion. The gear head can then be pivoted about the pivot axis, for example into an intermediate position in which the output rotational axis assumes a 45° position in relation to the elongate axis of the drive arm. The gear head may, however, also be pivoted further into a 90° position, in which the drive arm lies in a power-action screwdriver position in relation to the output rotational axis. The elongate axis of the drive arm then lies in a position pivoted by 90° with respect to the output rotational axis. The detent recess in which the latch pin engages in this position is located in the annular gear housing. This detent recess lies in the same plane in which a diametrically-opposed detent recess and the two bearing pins also lie. The domed portion serves not only for the reversing of the direction of rotation of the ratchet or freewheel gear. The domed portion may also be displaced in the axial direction with respect to the output rotational axis. This displacement takes place against the restoring force of a spring for the displacement of a release slide. The release slide is part of a retaining device for a socket or the like, which can be fitted onto the square drive output element. In the quick-action screwdriver position, the domed portion can be displaced with the aid of one of the two sliding buttons. For this purpose, the sliding button disposed near the root of the fork is displaced in the opposite direction, that is to say toward the securing fork, whereby the latch pin is pressed deeper into the detent recess of the domed portion. It thereby acts on the bottom of the detent recess and displaces the domed portion in the axial direction of the output rotational axis, in order to displace the release slide. The latter interacts with a detent ball, which enters a corresponding detent recess in a wall of an insert opening of the socket. The latch pin is held by two oppositely-acting compression springs in a neutral position, from which it can be displaced either into a release position for the pivoting of the gear head or for the release of the retaining device. In the retaining position, the detent ball lies in front of a wall of the release slide. In the release position, the detent ball can move radially inward out of the way. For this purpose, the release slide has a pocket. When the release slide is displaced back into its retaining position, the ball is displaced radially outward again by a sloping side wall of the pocket. The domed portion of the gear head forms a direction changeover switch for the freewheel gear. A radially outer portion of the domed portion may form a fluting. This portion is accessible in every pivoted position of the gear head, so that the directional block can be reversed in each pivoted position. By way of their mutually facing inner flanks, the fork prongs that form the gear-head bearing mount are in close surface-area contact with the convex outer surface of the gear housing. For this purpose, the inner flanks of the fork prongs are hemispherically shaped. During assembly, the gear head can be angled into this ball mounting. The fork prongs are fixedly associated with one another. This allows maximum torques to be applied to the square drive output element.

BRIEF DESCRIPTION OF THE DRAWINGS

Exemplary embodiments of the invention are explained below on the basis of accompanying drawings, in which:

FIG. 7 shows a second exemplary embodiment of the invention in a perspective representation, in a power-action screwdriver position.

DETAILED DESCRIPTION OF THE INVENTION

Figures 1, 2:
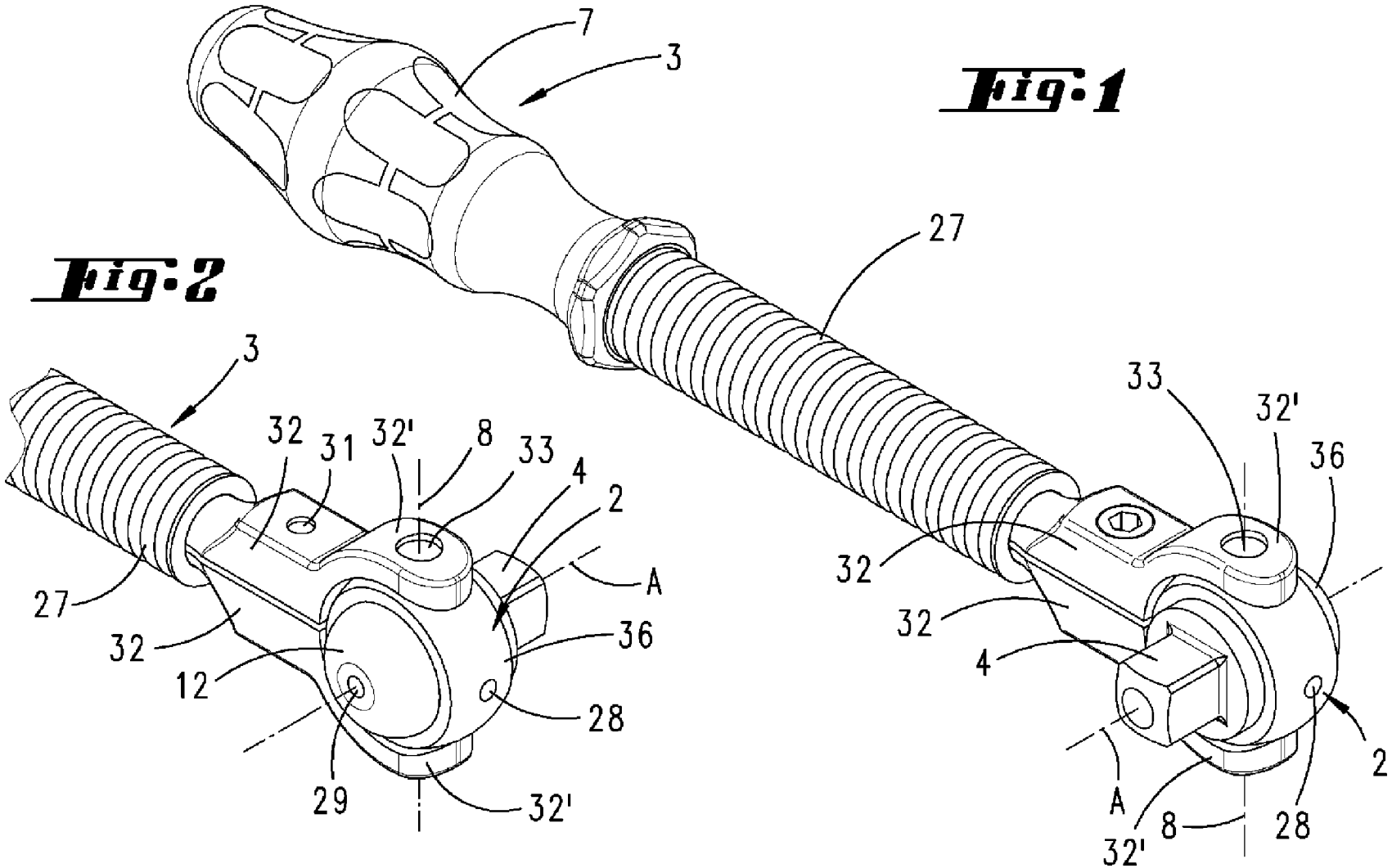
FIG. 1 shows a first exemplary embodiment of the invention in a perspective representation, with the drive arm in a pivoted position corresponding to the power-action screwdriver position.
FIG. 2 shows a representation corresponding to FIG. 1, but turned through 180°.
Figure 3:
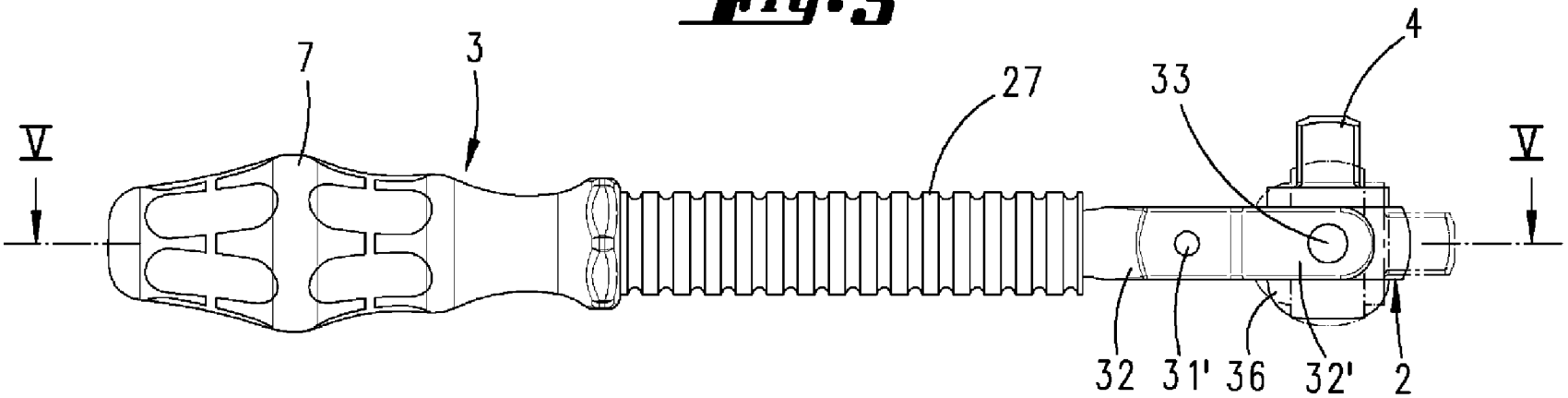
FIG. 3 shows a side view of the screwdriving tool according to FIG. 1, with the quick-action screwdriver position represented by dashed lines.
Figure 4:
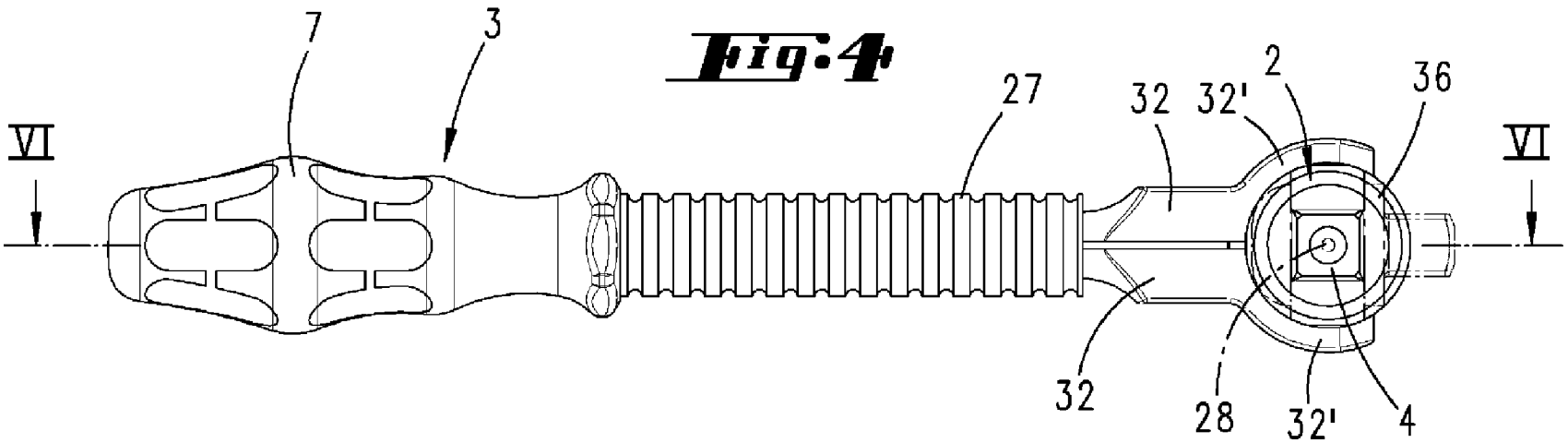
FIG. 4 shows a representation according to FIG. 3 turned through 90°, likewise with the quick-action screwdriver position represented by dashed lines.

The exemplary embodiment represented in the figures concerns a ratchet, in which the ratchet head forms a freewheel gear 2. The gear housing forms a ring 36, from which bearing extensions 33 protrude in diametrically opposite directions. The pivot axis 8 defined by the bearing extensions 33 intersects the rotational axis of the freewheel gear 2 defined by the square drive output element 4.

The drive arm 3 has, at its free end, a screwdriver handle 7. From the screwdriver handle, there protrudes a fork-shaped shank. At their ends, the two fork legs 32 of the shank form two arms 32', which between them leave a cavity which corresponds to the circumferential shape of the annular housing 36. At the free ends of the two arms 32', there are bearing openings, which are in line with each other and in which the bearing extensions 33 of the annular housing 36 are fitted. The two fork legs 32 are spaced slightly apart from each other. In the spacing between the two fork legs 32, there is a latch slide 21, which extends over the entire length of the shank of the drive arm 3. A portion 21' of the latch slide 21 that protrudes into the receiving opening, disposed between the arms 32', for the freewheel gear 2, forms a detent extension, which, in a detent position, can enter one of the detent recesses 28, 29 of the freewheel gear 2. In the region of the free end of the two fork legs 32, there is a screw 31, connecting the two fork legs 32 to each other. The threaded shank 31' of the screw 31 passes through the free space between the two fork legs 32 and a slot 30 in the latch slide 21. The latch slide 21 can be displaced by means of an actuating button (not represented) in the direction of the screwdriver handle portion 7 against the restoring force of a compression spring (not represented). As a result, the detent extension 21' comes out of the corresponding detent recess 28, 29. The actuation can take place from the end of the handle 7.

The housing of the freewheel gear 2 has a total of three detent recesses 28, 29. All of the detent recesses 28, 29 are spaced equally from the pivot axis 8. Two detent recesses 28 lie diametrically opposite each other in a position in which they are 180° apart with respect to the pivot axis 8 and are associated with the annular housing 36.

On the bisector of the angle, that is to say in a 90° position in relation to the detent recesses 28, there is a detent recess 29 in the region of the vertex of a domed portion which forms a direction-of-rotation reversing switch 12. The detent recess 29 lies in the rotational axis A.

The shank that is formed by the two bearing extensions 32 has a circular outer cross-section. Rotatably mounted on this circular portion, which directly adjoins the screwdriver handle 7, is a sleeve. The sleeve may be associated with the shank in an axially fixed manner.

Figure 5:
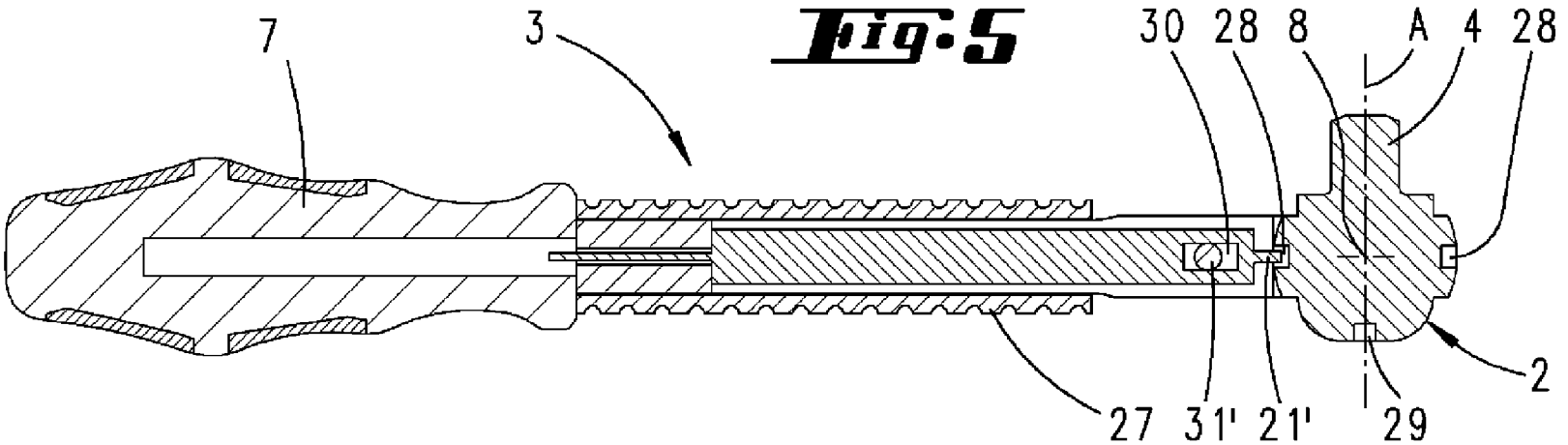
FIG. 5 shows a section along the line V-V in FIG. 3, the freewheel gear not being represented.
Figure 6:
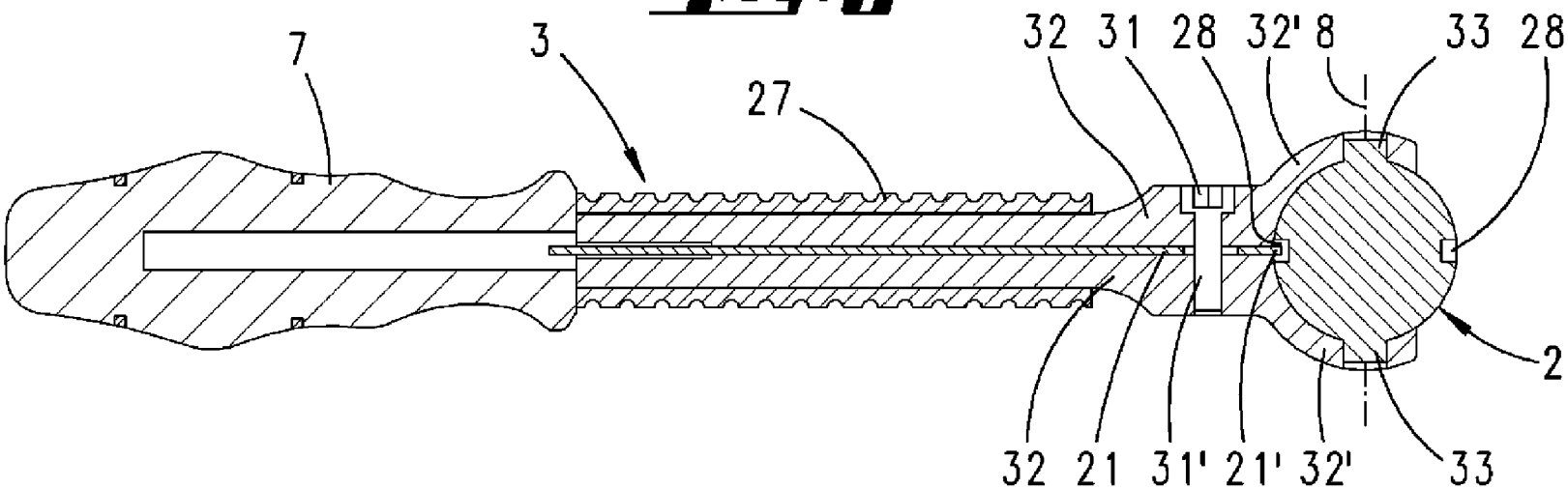
FIG. 6 shows a section along the line XIX-XIX in FIG. 4, the freewheel gear once again not being represented here.
Figure 4:
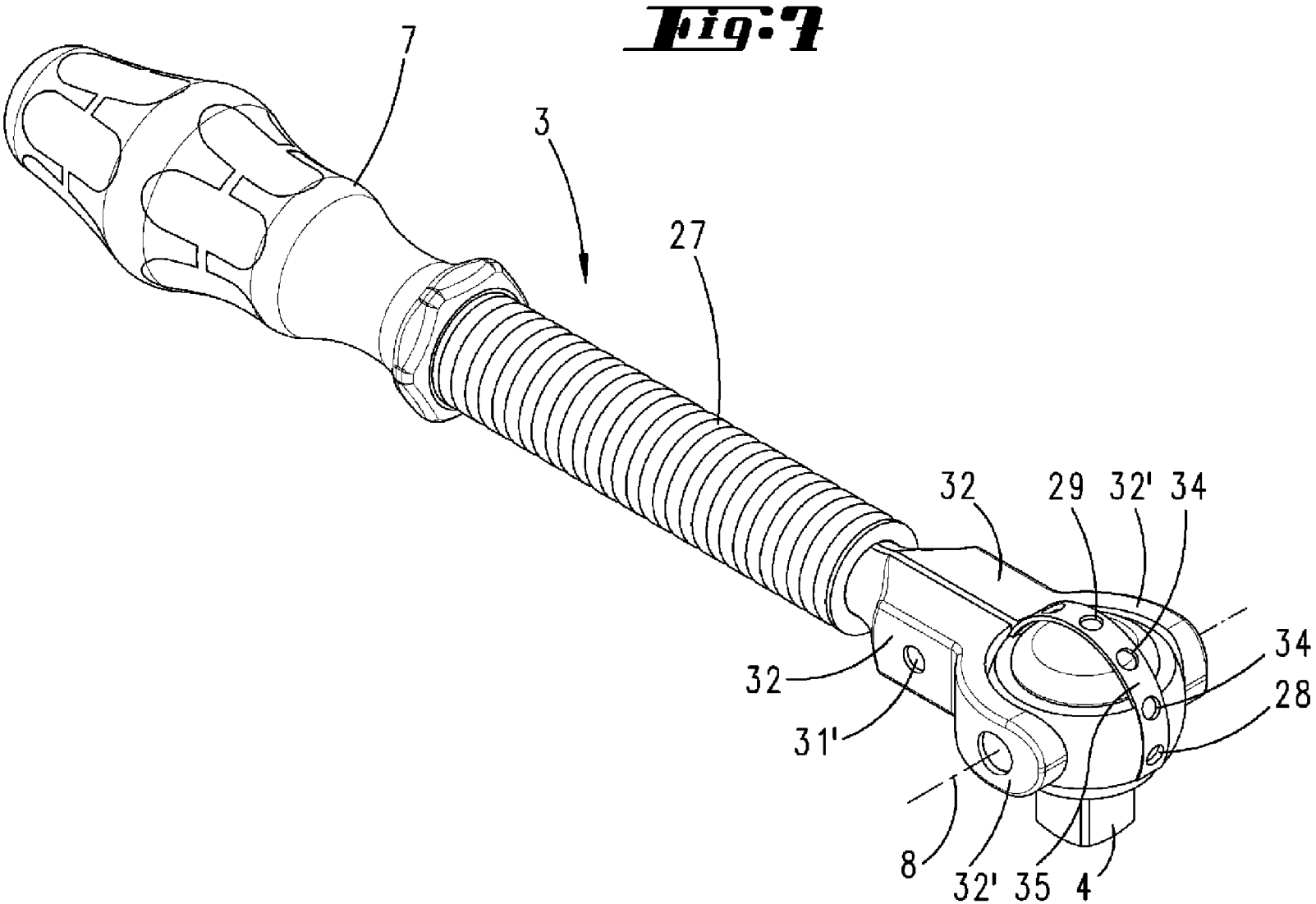
Figure 8:
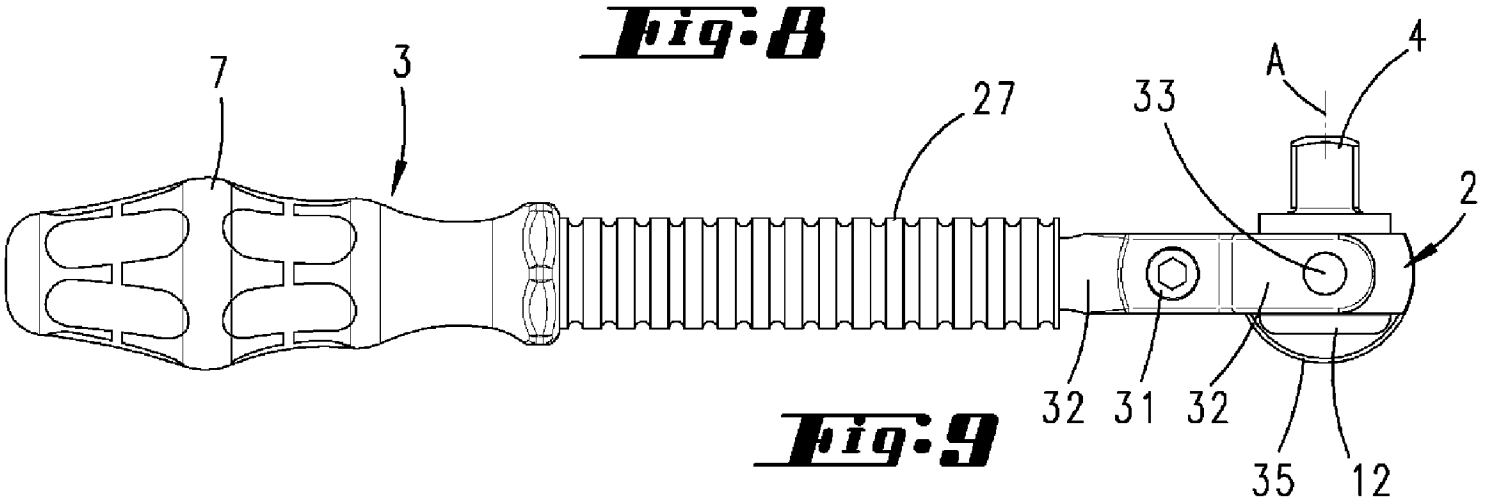
FIG. 8 shows a side view of the exemplary embodiment according to FIG. 7.
Figure 9:
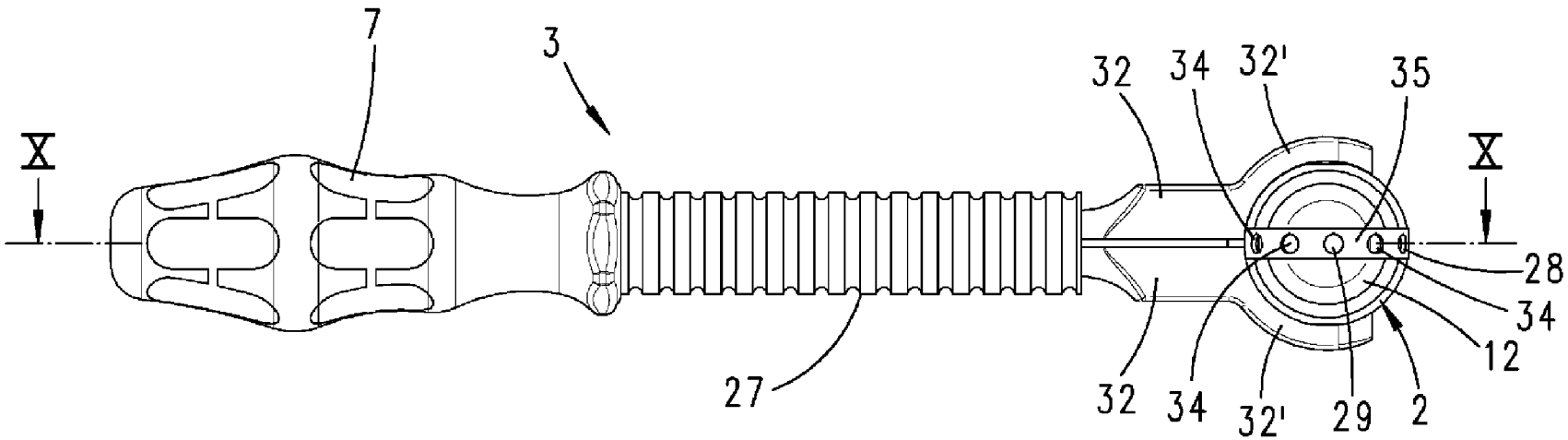
FIG. 9 shows a plan view of the exemplary embodiment according to FIG. 7.
Figure 10:
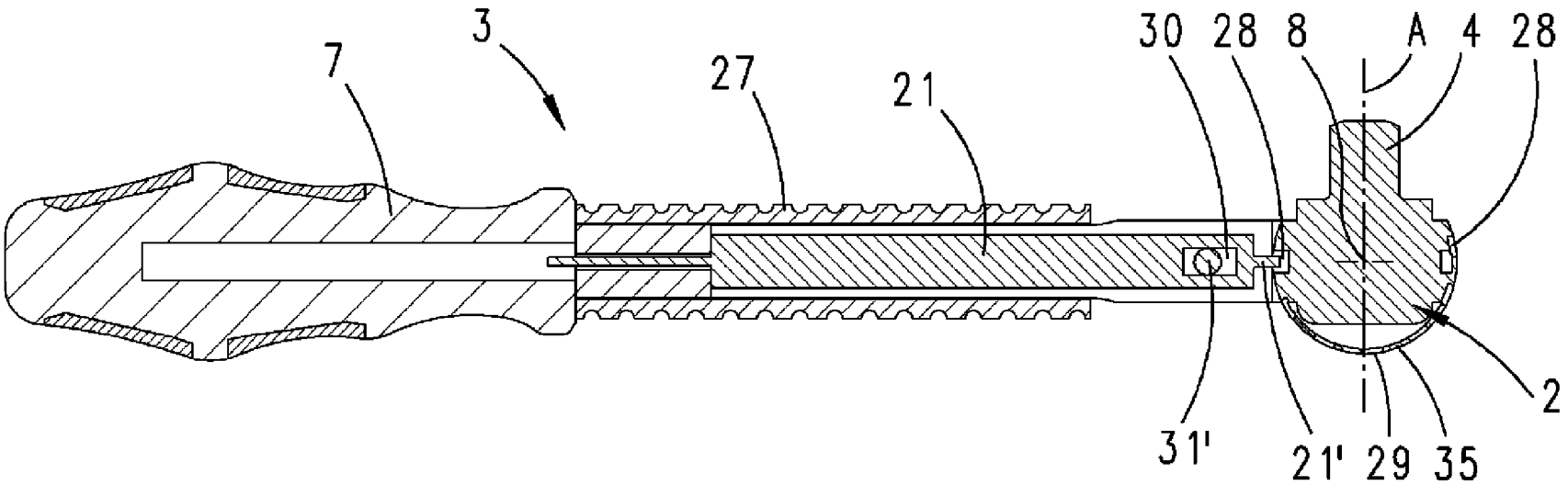
FIG. 10 shows a section along the line X-X in FIG. 9.

The screwdriving tool operates as follows:

If the screwdriving tool is in the power-action screwdriver position represented in FIG. 1, the drive arm 3 protrudes substantially at right angles in relation to the rotational axis of the freewheel gear 2. As can be gathered from FIGS. 5 and 6, in this position, the detent extension 21' protrudes into a detent recess 28. The detent arrangement is configured in such a way that it can only be released deliberately, i.e. by withdrawing the latch slide 21. The freewheel gear 2 is consequently connected to the drive arm 3 in a pivotally fixed manner. The tool can be used in a known way as a ratchet, the square drive output element 4 being turned step by step about the rotational axis A by pivoting the drive arm 3 back and forth.

Withdrawing the latch slide 21 into the shank, against the restoring force of the spring (not represented), causes the detent extension 21' to come out of the detent recess 28. The freewheel gear 2 can then be pivoted about the pivot axis 8, that is to say about the bearing extensions 33 which lie rotatably in the bearing openings. If the latch slide 21 is released, the extension 21' butts against the hemispherical domed portion of the direction-of-rotation reversing switch 12. The extension 21' slides on this domed surface until it can enter the detent recess 29, which is located in the region of the vertex point of the domed portion. The drive axis A then lies at the center of the shank or of the drive arm 3. The screwdriver handle 7 can then be turned in the usual way. In this quick-action screwdriver position, the drive output portion 4 is turned about its own axis by turning the screwdriver handle 7. In this case, one of the user's hands can operate the screwdriver handle 7. The other hand can securely hold the tool by the rotatable sleeve 27. An axial force can be applied by way of the rotatable sleeve 27, since the rotatable sleeve 27 can also be firmly grasped during the rotational actuation.

The displacement from this quick-action screwdriver position back into the power-action screwdriver position requires that the latch slide 21 is first withdrawn.

The further exemplary embodiment represented in FIGS. 7 to 10 likewise relates to a screwdriving tool with a pivotable drive arm, it being possible for the pivoted positions to be locked by detent engagement in at least a quick-action screwdriver position and a power-action screwdriver position. Unlike in the case of the exemplary embodiment described above, the detent openings 28, 29 are formed in a strip 35, which reaches over the direction-of-rotation reversing switch 12, spanning it, leaving a space in between. The strip 35 extends over a semicircular arc within the mouth of the fork that is formed by the arms 32'. On the strip 35, there are further detent recesses 34, each offset by an angle of 30°, so that the drive arm 3 can also be locked in intermediate pivoted positions.

Figure 11:
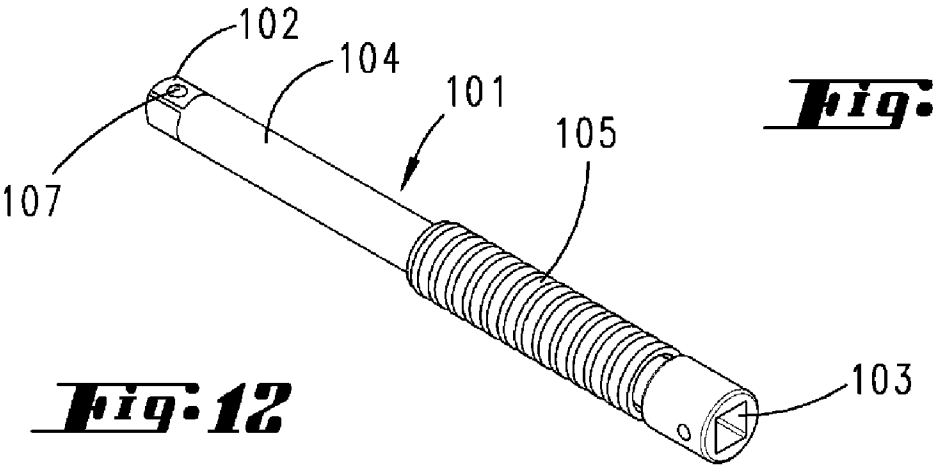
FIG. 11 shows a further exemplary embodiment of the invention in a perspective representation.
Figure 12:
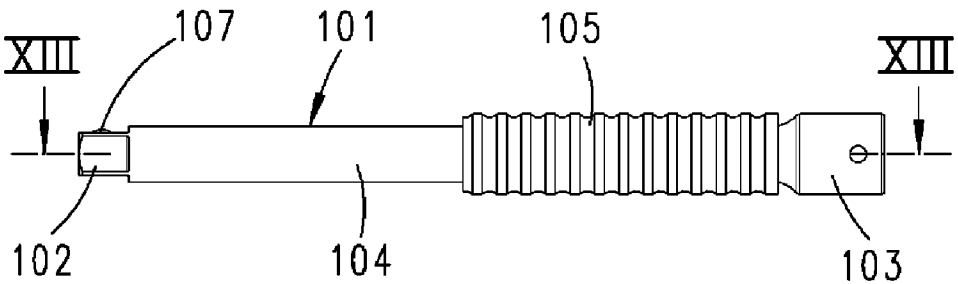
FIG. 12 shows the exemplary embodiment according to FIG. 11 in a side view.
Figure 13:
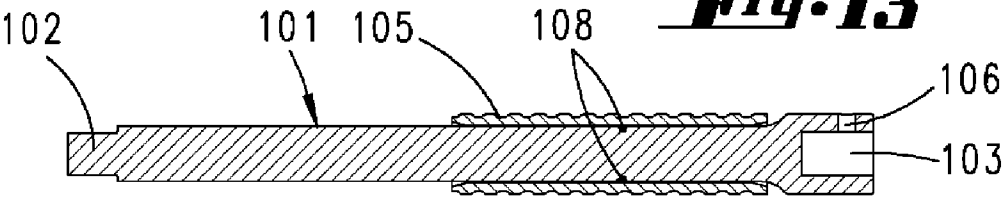
FIG. 13 shows a section along the line XIII-XIII in FIG. 12.
Figure 14:
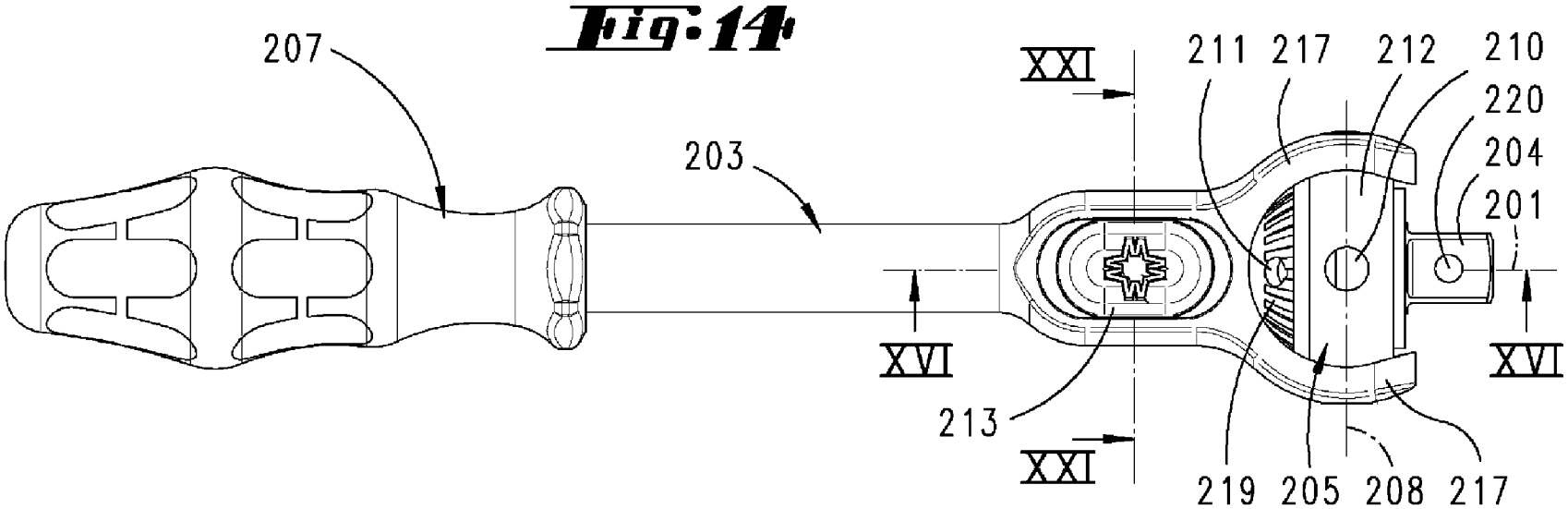
FIG. 14 shows a further exemplary embodiment of a screwdriving tool in a plan view, in a quick-action screwdriver position.
Figure 15:
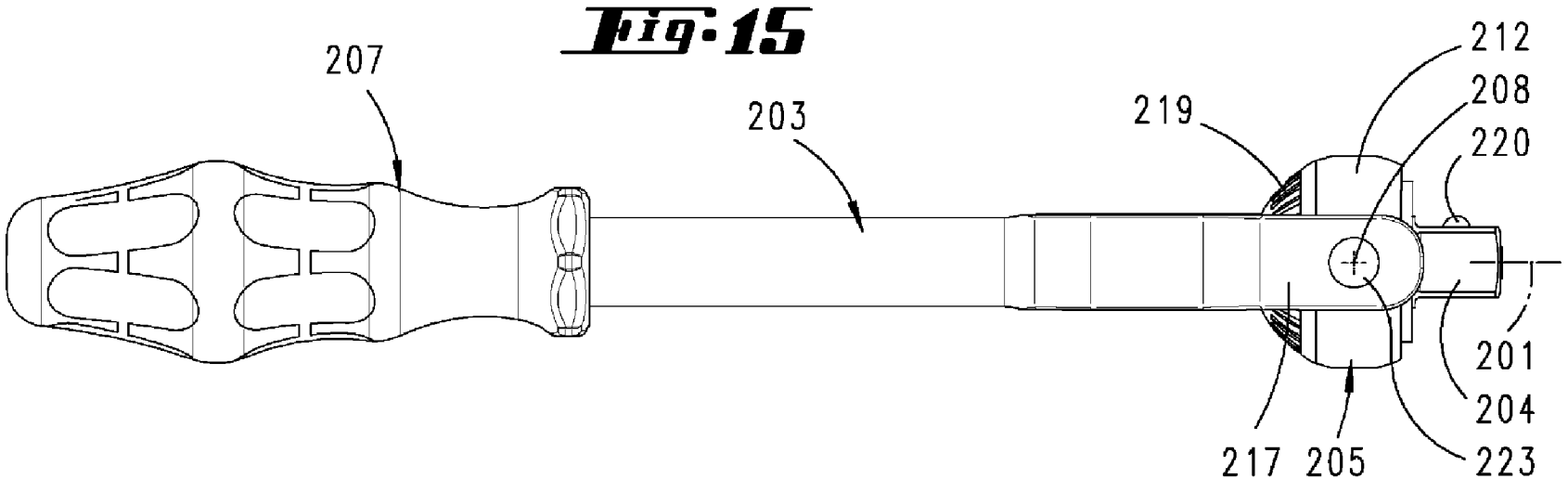
FIG. 15 shows a side view thereof.

FIGS. 11 to 13 show an extension piece 101, which consists of steel. It has a shank 104 with a circular cross-section. One end of the shank 104 is formed as a square element 102. In one of the faces of the square portion 102, there is a detent ball 107, a certain region of which protrudes beyond the face of the square element. This detent ball 107 can be pushed into the face of the polyhedral element against the restoring force of a spring.

The other end of the shank 104 forms a square cavity 103. A square element corresponding to the shape of the square element 102 can be inserted into the square cavity 103. The detent ball 107 can in this case enter a detent recess 106 of one of the polyhedral faces of the square cavity 103. On the cross-sectionally round shank, there is a rotatable sleeve 105. While the shank 104 consists of steel, the sleeve 105 may consist of plastic. The sleeve 105 has a fluted outer surface and a cavity, the diameter of which is slightly greater than the outside diameter of the shank 104.

Approximately midway in the axial direction, the sleeve 105 is retained on the shank 104 in an axially fixed but rotatable manner. For this purpose, the shank has an annular groove, in which a bearing ring 108 lies. A radially outwardly facing portion of the bearing ring 108 protrudes into a circumferential groove in the inner wall of the cavity of the sleeve 105.

The sleeve 105 serves for securing the extension piece 101 during the actuation screwdriving. For example, the square drive output element 4 of a freewheel gear of a screwdriving tool according to one or more of the preceding exemplary embodiments can be inserted into the polyhedral cavity 103. An axial force can be applied by way of the sleeve 105 in the direction of the polyhedral element 102, which can be inserted into a corresponding polyhedral opening of a socket.

The extension piece represented in FIGS. 11-13 can be combined with a screwdriving tool such as that described above or still to be described below. It can in this case be used both in the quick-action screwdriver position and in the power-action screwdriver position. The user can hold the extension piece with one hand by the sleeve 105. With the other hand, the ratchet wrench can either be turned in the quick-action screwdriver position or pivoted in the power-action screwdriver position. Since the ratchet wrench has a high mass, in the quick-action screwdriver position, angular momentum can be imposed on it by twisting the handle. When merely screwing a nut loosely onto a thread or screwing a screw loosely into a counter thread, the screwdriving tool can perform a large number of free rotations in the quick-action screwdriver position. Use of the sleeve 105 reduces friction, so that a single rotary driving action effected by the user's hand is sufficient to make the screwdriving tool subsequently perform multiple rotations freely about its axis.

FIGS. 14-21 show a ratchet wrench with a pivotable gear head 205. The gear head 205 has an square drive output element 204, which may have a size of ¼ inch, ⅜ inch or ½ inch. The square drive output element 204 defines an output rotational axis 201. The square drive output element 204 can be inserted into a square opening of a socket or some other torque transferring aid. A detent ball 220 protrudes from one of the four walls of the square drive output element 204. In its retaining position represented in FIG. 16, the detent ball 220 is supported on a wall portion of a release slide 221, which is located within the square drive output element 204. The release slide 221 is displaceably mounted in an axial cavity of the square drive output element 204.

Figure 16:
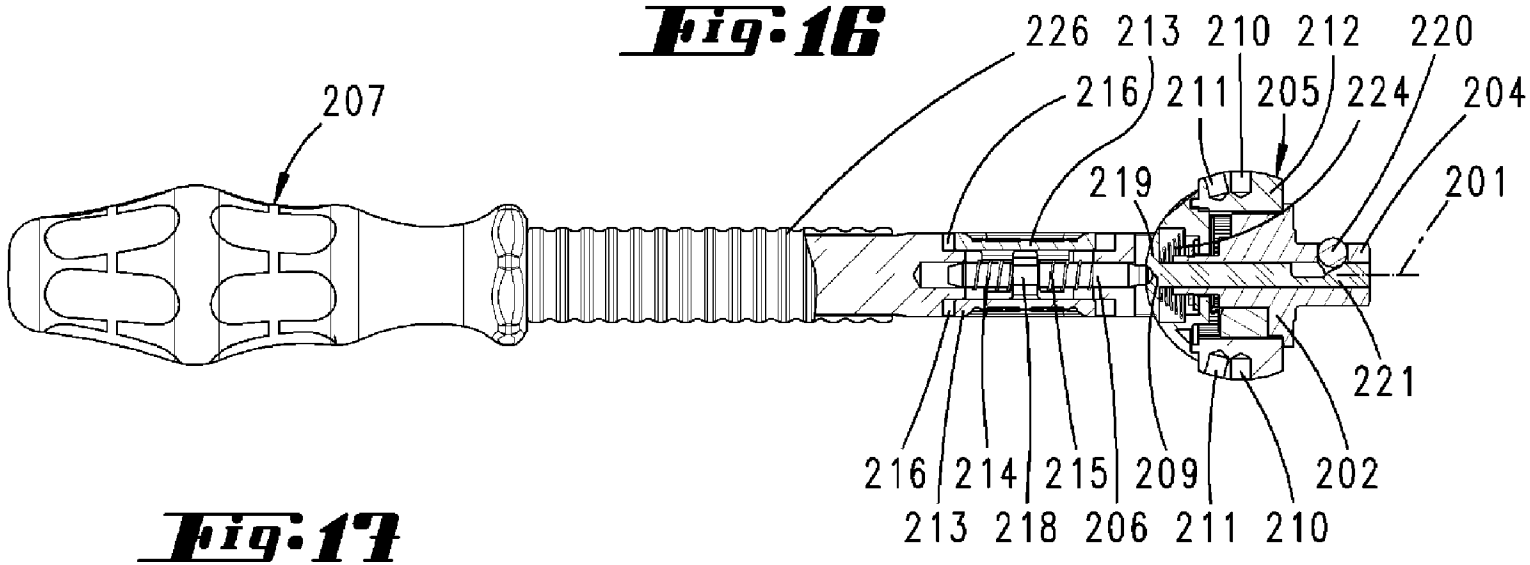
FIG. 16 shows a section along the line XVI-XVI in FIG. 14.
Figure 18:
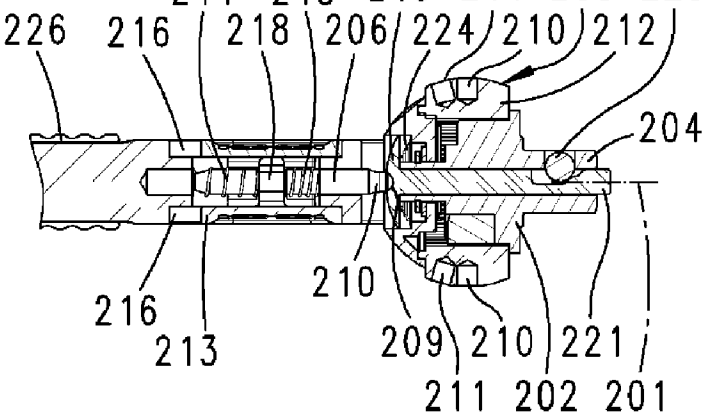
FIG. 18 shows a representation according to FIG. 17, with the latch pin displaced in the opposite direction.
Figure 17:
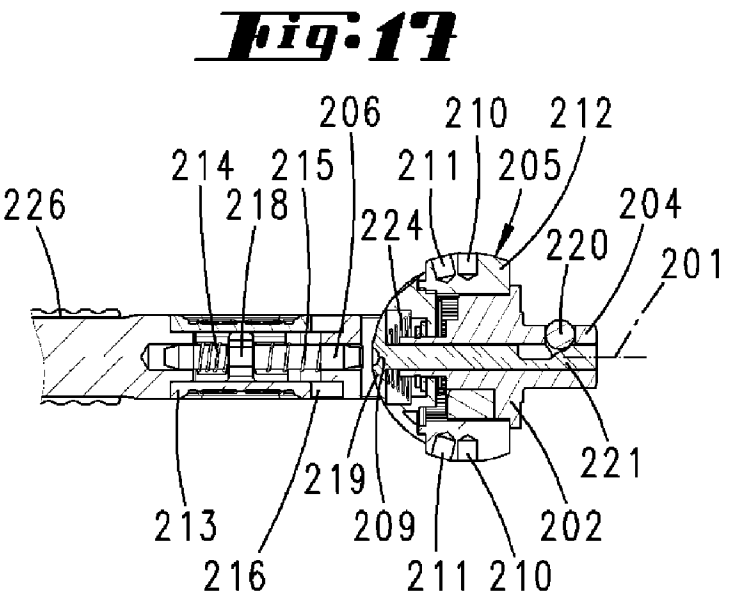
FIG. 17 shows a detail from the section according to FIG. 16, with the latch pin withdrawn into a release position.
Figure 19:
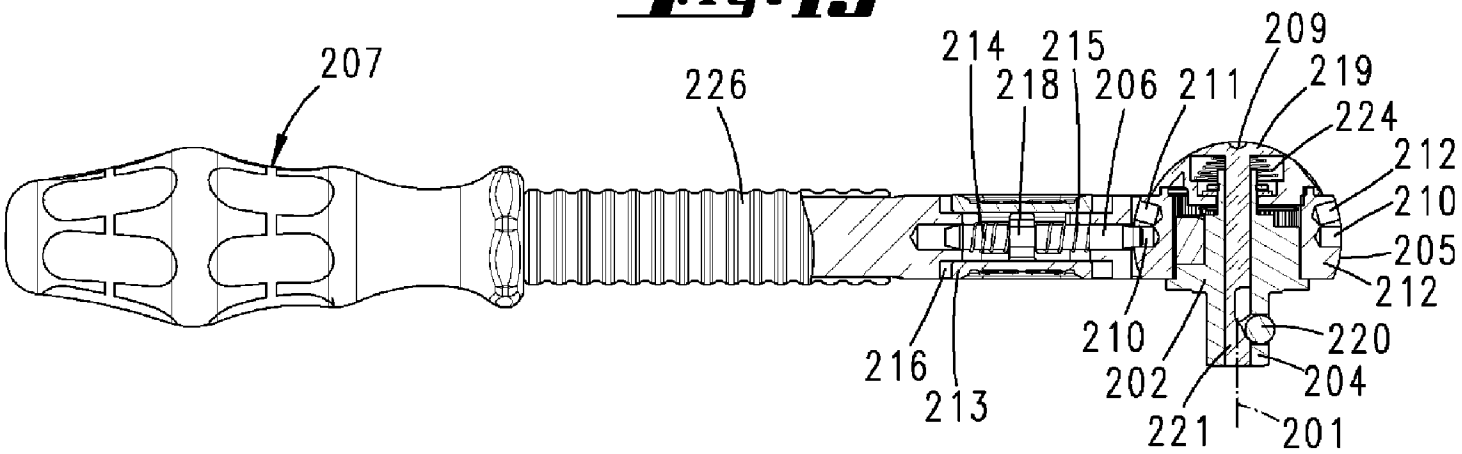
FIG. 19 shows a representation according to FIG. 16 in the power-action screwdriver position.

An axial displacement of the release slide 221 from the retaining position represented in FIG. 16 into a release position represented in FIG. 18 causes a recess of the release slide 221 to move into a rearward position in relation to the detent ball 220, so that the latter can radially enter the window, by its being mounted on the wall of the square drive output element 204. The axial displacement of the release slide 221 takes place against the restoring force of the compression spring 224. If the compression spring 224 displaces the release slide 221 back again into the retaining position, the detent ball 220 is displaced radially outward again by a sloping flank of the recess, so that it can retain the socket fitted on the square drive output element 204.

The square drive output element 204 is fixedly connected to a freewheel gear 202 of the gear head 205, the gear head not being represented in detail. The freewheel gear 202 is located within a free annular space formed by a gear housing 212. The gear housing 212 has a substantially annular shape. On the side of the gear housing 212 opposite from the square drive output element 204, there is a domed switching portion 219. This may consist of metal or plastic. The gear housing 212 preferably consists of steel, similarly to the square drive output element 204. The domed switching portion 219 can be turned about its switching axis, which coincides with the output rotational axis 201, in order to change over the blocking direction or the release direction of the freewheel gear 202, which is merely indicated. The freewheel gear 202 has a ratchet mechanism or the like, which allows rotation of the square drive output element 204 in one direction and blocks it in the other direction, respectively. The domed portion 219 may additionally also be displaced axially in the direction of the output axis 201. This takes place against the restoring force of a compression spring 224. This axial displacement of the domed switching portion 219 is accompanied by the release slide 221 being displaced from its retaining position into its release position. The release slide 221 is fixedly connected to the domed portion 219 as regards movement. The domed portion 219 lies with a corresponding freedom of axial movement in a bearing recess of the gear housing 212.

The gear housing 212 has two diametrically-opposed detent recesses 210. Between the two detent recesses 210, the gear housing 212 has bearing openings, in which bearing pins 223 are engaged. The bearing pins 223 define a pivot axis 208, which intersects the output rotational axis 201 at right angles. The gear head 205 is pivotably mounted by the bearing pins 223 in a securing fork of a drive arm 203. The securing fork is formed by two arcuate fork prongs 217. The inner wall of the fork prongs 217 is of a hemispherical shape. Consequently, in the power-action screwdriver position represented in FIG. 19, the inner wall of the fork prongs 217 comes into substantially flush contact with the surface of the gear housing 212.

The domed portion 219 has, at its vertex point, a detent recess 209. Disposed between the detent recess 210 of the gear housing 212 and the central detent recess 209 is a further detent recess 211. This is likewise associated with the gear housing 212. Further detent recesses could also be provided in the region of the domed switching portion 219.

In the region of the vertex of the securing fork, that is to say in the region of its root, there is a bore, which extends axially in relation to the elongate axis of the drive arm 203. Inserted in this bore is a latch pin 206. The end portion of the latter, protruding from the bore into the space defined within the fork, can lie in one of the detent recesses 209, 210 or 211. The gear head 205 thereby assumes various angular positions. In the position represented in FIG. 19, the latch pin 206 lies in one of the two detent recesses 210 of the gear housing 212. In this operating position, the drive arm 203 extends in a direction transverse to the direction in which the output rotational axis 201 extends. With the handle 207, located on the end of the drive arm 203, a high torque can then be applied to the square drive output element 204. A pivoting movement of the drive arm 203 causes the square drive output element 204 to be turned further, step by step, in one direction.

Figure 20:
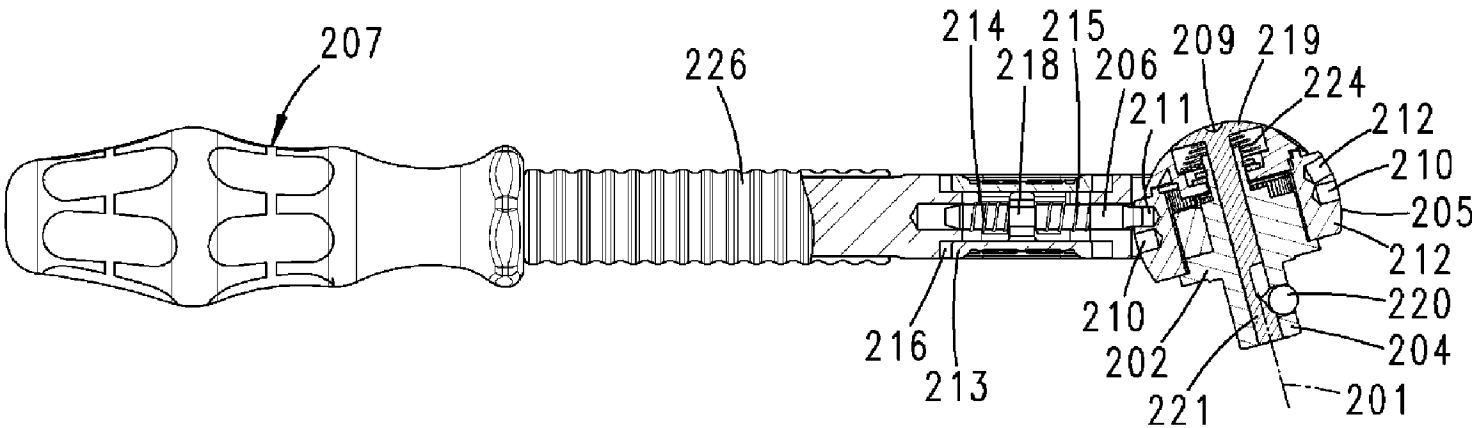
FIG. 20 shows an intermediate position between the quick-action screwdriver position and the power-action screwdriver position, in a representation according to FIG. 17.
Figure 21:
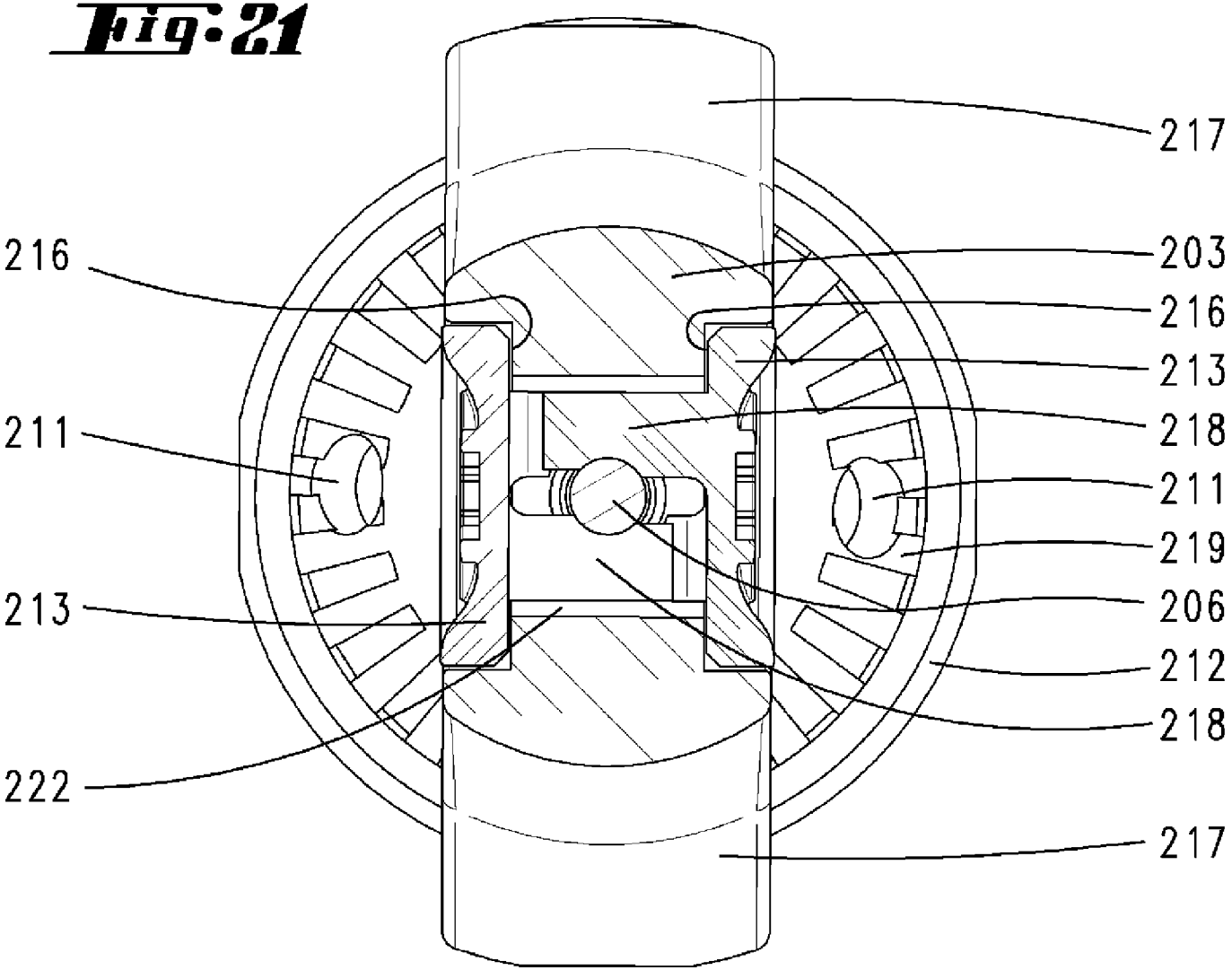
FIG. 21 shows a section along the line XXI-XXI in FIG. 14.

In the position represented in FIG. 20, the end of the latch pin 206 is in the detent opening 211. In this position, the output rotational axis 201 is at an angle of approximately 75° to the direction in which the drive arm 203 extends.

The portion of the drive arm 203 directly bordering the root of the securing fork is widened. In this widened portion, there is a sliding button 213. On each of the two broad sides of this portion, facing away from each other, there is a sliding button 213. The region between the handle 207 and the widened portion of the drive arm 203 has a circular, narrower cross-section.

The two sliding buttons 213 have connecting cross-pieces 218, which reach into a through-opening 222. The two sliding buttons 213 are connected to each other by the connecting cross-pieces 218. The connecting cross-pieces 218 lie laterally offset and axially offset in relation to each other. They may form hooks (not represented), in order to lock the two opposing sliding buttons 213 to each other. The connecting cross-pieces 218 thereby overlap each other. The connecting cross-pieces 218 also form a positively driving coupling with the latch pin 206, to allow the latter to be displaced in the direction of its axis. Each of the two sliding buttons 213 lies in a recess 216 in the flat portion of the drive arm 203.

The sliding button 213 engages with its connecting cross-piece 218 on the latch pin 206. The connecting cross-piece consequently forms the connection between the sliding button 213 and the latch pin 206. On both sides of the connecting cross-piece 218, there are compression springs. A first compression spring 214 must be compressed in order to withdraw the latch pin 206 from one of the detent recesses 209, 210 or 211. The other compression spring 215 is compressed by a displacement of the sliding button 213 in the opposite direction. The compression springs 214, 215 are respectively supported on the connecting cross-pieces 218 and on the wall of the through-opening 222. An accompanying effect is that the latch pin 206 is pressed deeper into the space within the fork or into the detent recess 209. If the latch pin 206 is pressed into this detent recess 209 associated with the vertex point of the domed portion 219, the domed portion 219 is displaced. This is accompanied by the release slide 221 being displaced into its release position.

The two springs 214, 215 hold the sliding button 213 or both sliding buttons 213 in a central neutral position, from which they can be displaced in respectively opposed actuating directions, in the direction in which the drive arm 203 extends, in order either to release the detent ball 220 or to enable the gear head 205 to pivot.

The two sliding buttons 213 can be displaced by the thumb of the user's hand. The two sliding buttons 213 therefore preferably lie very near the gear head 205, that is to say at the end of the drive arm 203 that is opposite from the handle 207. As a result of having a sliding button 213 disposed on both sides, the retention of the gear head 205 or the locking engagement of a socket can be released in every pivoted position of the drive arm 203. This is performed with a single actuating member, that is the sliding button 213. In the quick-action screwdriver position, the displacement of the sliding button 213 takes place in the direction of the output rotational axis 201. The bottom of the recess 216 lies in a parallel plane in relation to the plane in which the fork prongs 217 lie.

Between the handle 207 and the widened portion that carries the sliding button 213, the drive arm 203 is shaped in the form of a circular cylinder and is surrounded by a rotatable sleeve 226. The rotatable sleeve 226 may consist of plastic. It is associated with the drive arm 203 in an axially fixed but rotatable manner. In the exemplary embodiment, the rotatable sleeve 226 has a fluting. In the quick-action screwdriver position shown in FIG. 16, this sleeve can be grasped by one of the user's hands. With the other hand, the user can transfer a rotational movement to the handle 207. The user thereby transfers angular momentum to the screwdriving tool. Since the main elements of the screwdriving tool consist of steel, it has a great centrifugal mass. The user is consequently able to transfer relatively high angular momentum to the screwdriving tool. The screwdriving tool can consequently perform multiple rotations after application of a single rotary action.

The further exemplary embodiment represented in FIGS. 22-26 mainly differs from the exemplary embodiments described above by the increased centrifugal mass 225. The centrifugal mass 225 is formed here by outwardly facing bulges of the handle body. These convexities directly adjoin the fork prongs 217. As a result of this radially outer concentration of mass, which forms the centrifugal mass 225, increased angular momentum can be imposed on the screwdriving tool in the quick-action screwdriver position represented in FIG. 26. This angular momentum is transferred to the screw to be screwed in. The screwdriving tool can rotate freely, being held by the user by the rotatable sleeve 226.

The gear head 205 has two diametrically opposed radial extensions 227, associated with the gear housing 212. In the power-action screwdriver position, one of these radial extensions 227 respectively engages in a recess of a corresponding shape in the base of the fork between the two fork prongs 217. Each radial extension 227 has two driving flanks 228. The radial extension 227 lying in the opening in the base of the fork is disposed with its two driving flanks 228 against driving steps 229, which are formed by side walls of the recess in the base of the fork. This allows a greater torque to be transferred to the gear head 205 in the power-action screwdriver position. The two driving flanks 228 and the two driving steps 229 preferably lie respectively on parallel planes.

Figure 22:
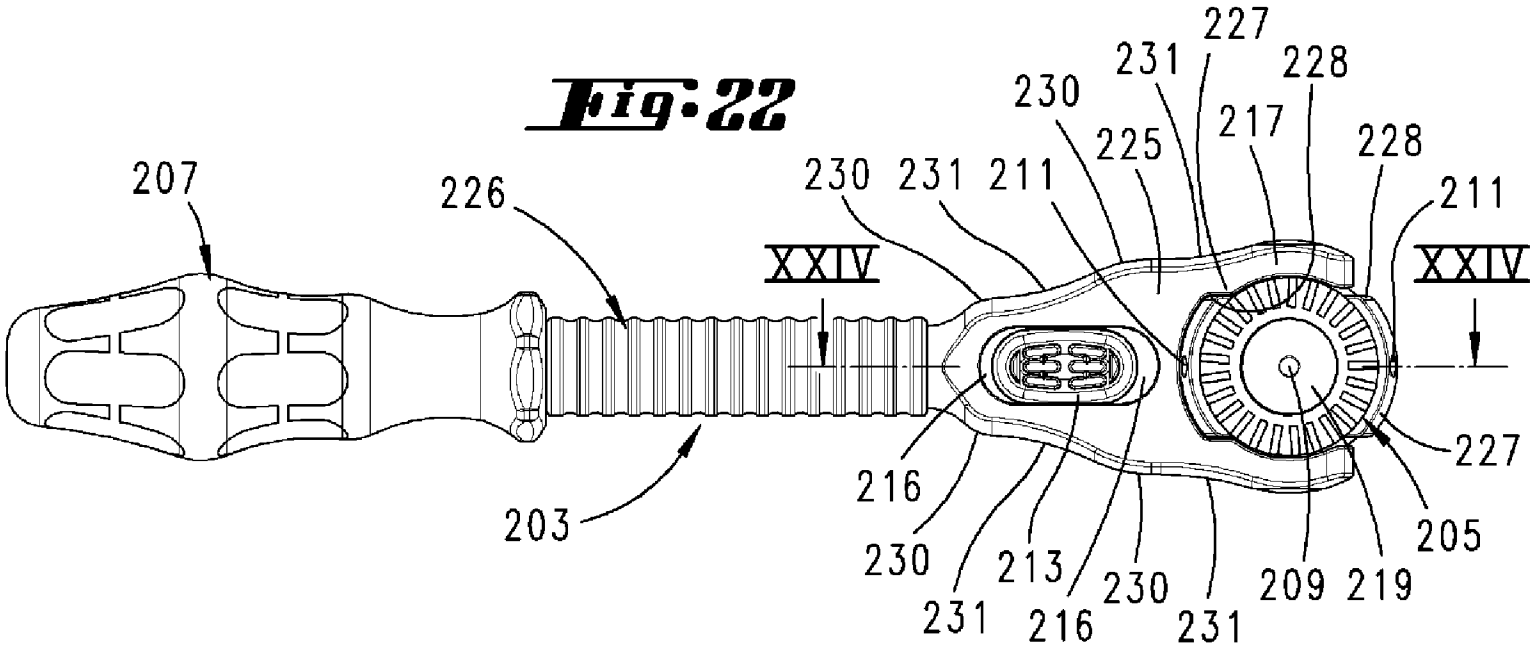
FIG. 22 shows a further exemplary embodiment of the invention in plan view, with the ratchet head pivoted into the power-action screwdriver position.
Figure 23:
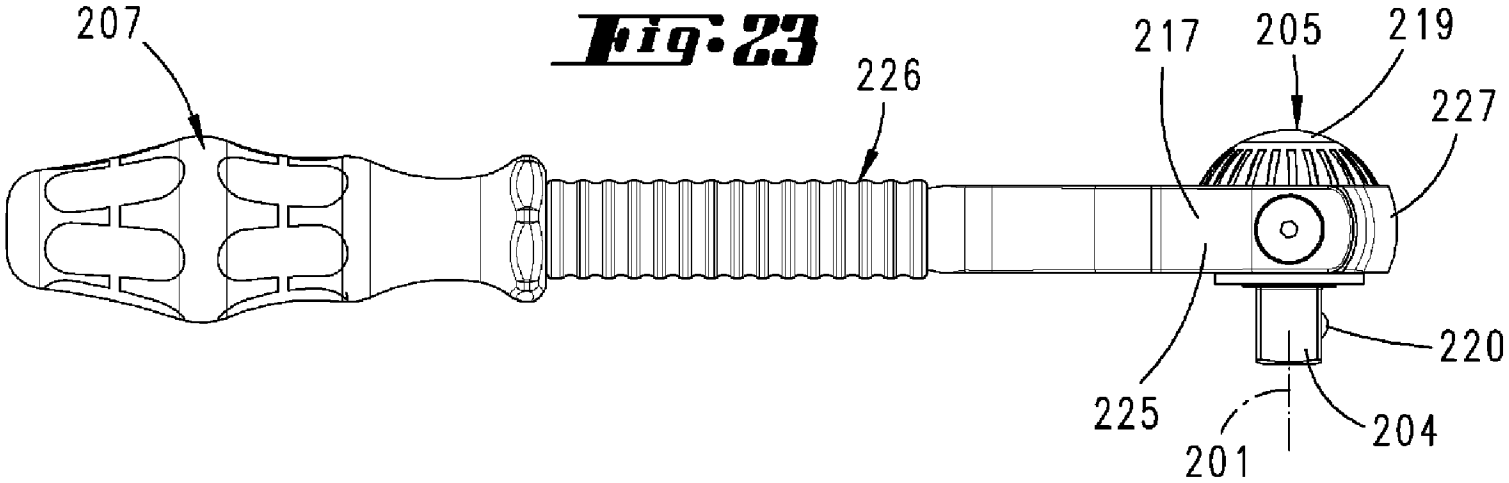
FIG. 23 shows a side view of the exemplary embodiment according to FIG. 22.
Figure 24:
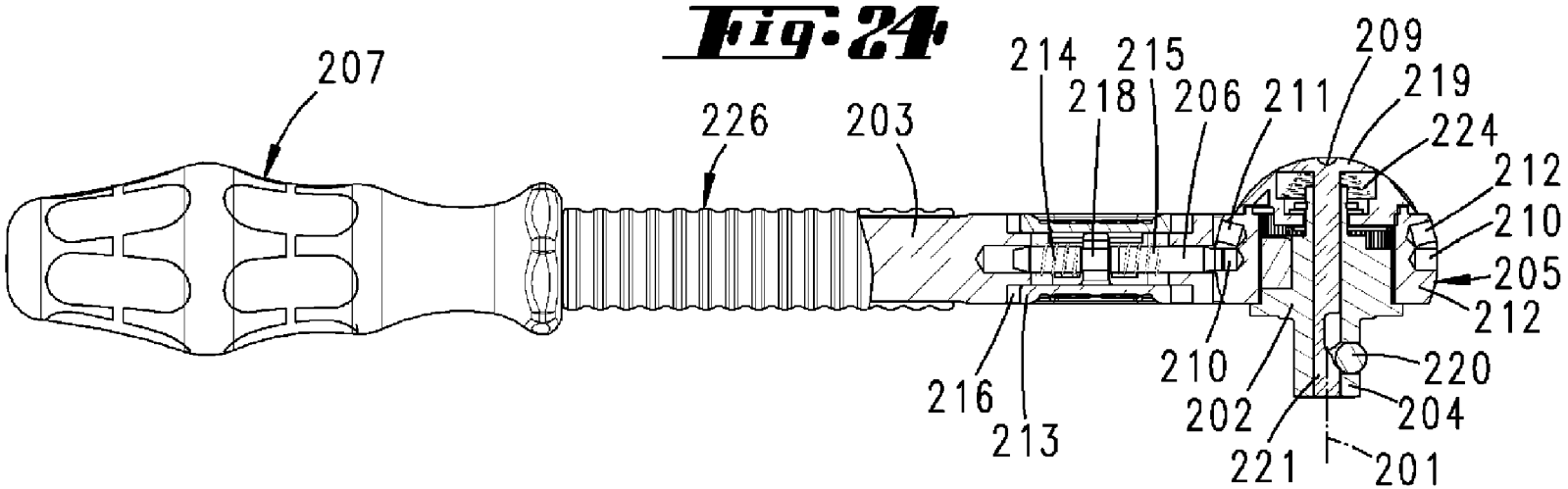
FIG. 24 shows a section along the line XXIV-XXIV in FIG. 22.
Figure 26:
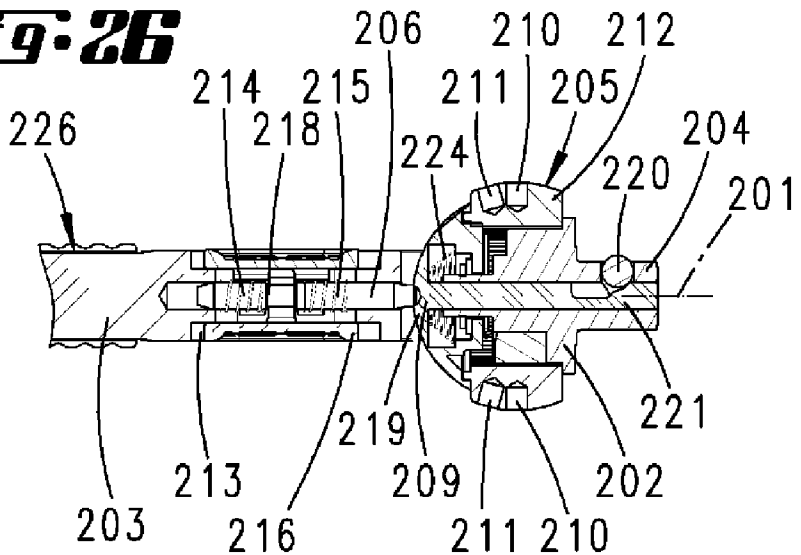
FIG. 26 shows a representation according to FIG. 25, with the ratchet head pivoted into the quick-action screwdriver position.
Figure 25:
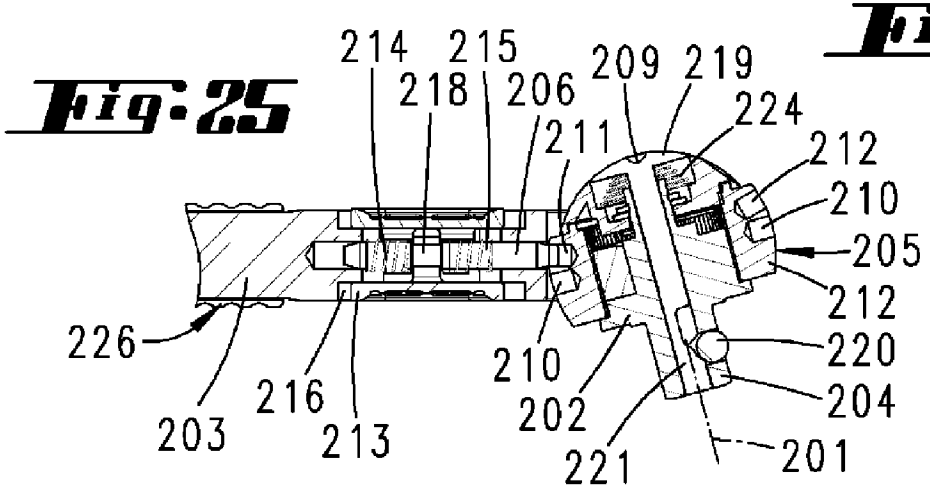
FIG. 25 shows a partial representation according to FIG. 24, in an intermediate pivoted position of the ratchet head

As can be gathered from FIG. 22, on each of the two narrow sides of the gear head which forms the centrifugal mass 225, there are a total of three convexities 230. Extending between the individual convexities 230 are dished grips 231. These dished grips have a width that is large enough to allow the finger of a hand grasping the head that forms the centrifugal mass 225 to engage in them. A total of two dished grips 231 are provided, separated from each other by a central convexity 230. In the power-action screwdriver position represented in FIG. 22, the head forming the centrifugal mass 225 can be grasped by a user's hand. The hand also at the same time grasps the gear head 225. For quick turning of the output rotational axis 201, there is no need to take hold of the handle 207. In the case of quick-action screwdriving, the handle can pivot freely. It proves to be advantageous in this respect, if the center of gravity of the screwdriving tool as a whole lies in the third of the drive arm 203 on the output side. The center of gravity preferably lies in the region between the head 225 and the rotatable sleeve 226.

It proves to be advantageous that the handle 207 has rotational symmetry. It can then be rotationally driven by the thumb, index finger and middle finger of a user's first hand, while the user's second hand grasps the rotatable sleeve 226. In this way, angular momentum can be imposed on the screwdriving tool, so that it can freely perform multiple successive revolutions.

The hemispherical configuration of the changeover switch 219 and the ribs or grooves provided on the domed surface make it possible for the direction of rotation of the freewheel gear 202 to be changed over in every pivoted position of the gear head 205. The main features of the invention therefore include the fact that the freewheel gear 202 can be changed over in every pivoted position of the gear head 205.

The drive arm is made up of multiple parts. Its main components are a steel body, which forms the two fork prongs 32' or 217 and a circular-cylindrical shank for the mounting of the rotatable sleeve 27 or 226. The steel body, which may be a hardened forged part, additionally carries the detent device for the gear head and, at its free end, the plastic handle 207. The latter may be fitted onto the free end. It may also be molded onto the free end by the injection-molding process. The steel body is designed in such a way that its mass moment of inertia about the elongate axis, which coincides with the rotational axis in the quick-action screwdriver position, is very high, that is to say lies above a minimum value. In this case, the centrifugal masses are disposed so near the bearing fork for the gear head that the mass moment of inertia of the steel body about an axis extending through the fork perpendicularly to the elongate axis, corresponding to the rotational axis in the power-action screwdriver position, is minimized, that is to say lies below a maximum value.

In the case of the exemplary embodiments, the sleeve 226 or 105 is respectively secured to the drive arm 203 or to the shank 104 in an axially fixed manner. What is important is that the sleeve 226 or 105 is mounted rotatably on the drive arm 203 or shank 104. In a configuration that is not preferred, it may also be associated with the drive arm 203 or the shank 104 in an axially displaceable manner. The mounting of the sleeve 226, 105 may take place both by way of a plain bearing and by way of a ball bearing.

In the exemplary embodiments, the centrifugal masses 225 are in each case fixedly connected to the drive arm 203. However, the centrifugal masses may also be associated with the drive arm 203 in a radially displaceable or pivotable manner. The centrifugal masses may not only be disposed very near the drive head. It is also possible to locate the centrifugal masses at the free, handle end. This is of advantage in particular if the centrifugal masses can be displaced from a radially inner position into a radially outer position. The latter can be carried out by displacing or pivoting the centrifugal masses movably associated with the drive arm.

The centrifugal masses may also be associated with the drive arm in such a way that they can be automatically displaced by centrifugal force into a position increasing the moment of inertia. This may take place against a restoring spring.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application.

The invention claimed is:

1. A screwdriving tool with a drive arm formed at one end as a handle portion and a freewheel gear arranged at the other end of the drive arm, and having a gear head which can be turned round at least through 90° into retained positions, characterized in that between the handle portion and the gear head, there is, on the drive arm, a freely rotatable and axially non-displaceable hand-action sleeve and in that centrifugal masses are formed by convexities of the handle portion body, facing outward in the radial direction.

2. The screwdriving tool according to claim 1, characterized in that the drive arm has a metal body, which forms a bearing fork for the gear head, a shank portion for mounting the sleeve and an end portion for securing the handle portion, centrifugal masses being disposed near the bearing fork in such a way that values of the mass moment of inertia of the metal body with respect to an output rotational axis lie above a minimum value in a quick-action screwdriver position and below a maximum value in a power-action screwdriver position, the minimum value being 30 kg $mm^2$, 40 kg $mm^2$ or 45 kg $mm^2$ in the case of a screwdriving tool for a ½-inch output coupling, 15 kg $mm^2$, 20 kg $mm^2$ or 25 kg $mm^2$ for a ⅜-inch output coupling and 3 kg $mm^2$, 4 kg $mm^2$ or 4.5 kg $mm^2$ in the case of a ¼-inch output coupling.

3. The screwdriving tool according to claim 1, characterized in that the rotatable sleeve is associated with the drive arm in an axially fixed manner and is mounted by way of a ball bearing or a plain bearing.

4. The screwdriving tool according to claim 1, characterized by dished finger grips disposed between the radially outwardly facing convexities.

5. The screwdriving tool according to claim 1, characterized in that a center of gravity of the screwdriving tool lies in the third of the drive arm near the head and lies between the rotatable sleeve and a centrifugal mass.

6. The screwdriving tool according to claim 1, characterized in that the handle portion has rotational symmetry.

7. A screwdriving tool with a drive arm formed at one end as a handle portion and a freewheel gear arranged at the other end of the drive arm, and having a gear head which can be turned round at least through 90° into retained positions, characterized in that between the handle portion and the gear head, there is, on the drive arm, a freely rotatable and axially non-displaceable hand-action sleeve and wherein, the gear head forms a gear housing in which a freewheel or ratchet gear having an output rotational axis is disposed, a front side of the gear head having an output coupling, and the drive arm being pivotable about a pivot axis, which extends substantially transversely to the output rotational axis, from a quick-action screwdriver position, in which the drive arm lies on the output rotational axis, into a power-action screwdriver position, in which the drive arm extends substantially transversely to the output rotational axis, and it being possible to fix the drive arm in both pivoted positions by detent means, the detent means being displaceable from a detent position into a release position by means of an actuating member associated with the drive arm, the detent means being a latch pin which is disposed in the drive arm and can be displaced in the direction in which the drive arm extends, characterized in that the output coupling has a retaining device for a socket or the like that can be coupled thereto, which device can be brought from a retaining position into a release position by actuating the actuating member.

8. The screwdriving tool according to claim 7, characterized in that the actuating member is a sliding button which can be displaced in the direction in which the drive arm extends, against the restoring force of a spring.

9. The screwdriving tool according to claim 7, characterized in that the gear housing has a substantially circular outer wall, which is mounted at two diametrically opposed locations between ends of prongs of a securing fork of the drive arm embracing the gear housing.

10. The screwdriving tool according to claim 9, characterized in that a convex circumferential surface of the gear head lies with surface-area contact against the hemispherically-shaped inner walls of the fork prongs and radial extensions, which protrude from the gear housing in respectively diametrically opposite directions from each other, form driving flanks which lie against associated driving steps of the fork prongs.

11. The screwdriving tool according to claim 7, characterized in that the actuating member has two opposing sliding buttons, which are connected to the latch pin lying between them by means of connecting cross-pieces.

12. The screwdriving tool according to claim 7, characterized in that the latch pin or the actuating memberis held in a neutral, floating position between two springs.

13. The screwdriving tool according to claim 7, characterized by a domed portion which is opposite from the output coupling and forms a directional changeover switch for the freewheel or ratchet gear that is accessible in every pivoted position of the drive arm.

14. The screwdriving tool according to claim 13, characterized in that the retaining device can be brought into the release position by axial pressure on the domed portion.

* * * * *